United States Patent [19]

Bromfield

[11] Patent Number: 4,964,106

[45] **Date of Patent: * Oct. 16, 1990**

[54] FLEXTENSIONAL SONAR TRANSDUCER ASSEMBLY

[75] Inventor: George Bromfield, Salt Lake City, Utah

[73] Assignee: Edo Corporation, Western Division, Salt Lake City, Utah

[ * ] Notice: The portion of the term of this patent subsequent to Jul. 4, 2006 has been disclaimed.

[21] Appl. No.: 337,857

[22] Filed: Apr. 14, 1989

[51] Int. Cl.[5] ..... H04R 17/00; H04R 31/00

[52] U.S. Cl. ..... 367/165; 367/158

[58] Field of Search ..... 310/323, 325, 334, 337, 310/348; 367/155, 156, 157, 158, 162, 165, 168; 29/25, 35, 594

[56] References Cited

U.S. PATENT DOCUMENTS

| | | | |
|---|---|---|---|
| 2,849,628 | 8/1958 | Mollmann | 367/157 |
| 3,274,537 | 9/1966 | Toulis | 367/157 |
| 3,277,433 | 10/1966 | Toulis | 367/157 |
| 3,718,897 | 2/1973 | Abbott | 367/157 |
| 4,420,826 | 12/1983 | Marshall, Jr. et al. | 367/155 |
| 4,462,093 | 7/1984 | Upton | 367/165 |
| 4,731,764 | 3/1988 | Ponchaud | 367/158 |
| 4,845,687 | 7/1989 | Bromfield | 367/158 |

*Primary Examiner*—Brian S. Steinberger

[57] ABSTRACT

A flextensional sonar transducer assembly includes a stack of piezoelectric elements disposed along a linear axis, a plurality of electrodes disposed between the elements, end pieces disposed at each end of the piezoelectric stack, with the end pieces having outwardly facing, generally arcuate surfaces, a compression band formed into a loop to encircle the stack and end pieces, a flexural shell disposed to circumscribe the compression band to present a generally elliptical side cross-section, with the major axis thereof being generally coincident with the linear axis of the stack, and with the shell being reactively coupled to the arcuate end portions of the compression band, and rod members positioned between the compression band and the arcuate end portions of the band of material for maintaining driving contact between the shell and the end pieces, and for adjusting the prestress compression pressure in the stack. The invention also includes methods of manufacturing the transducer assembly.

10 Claims, 3 Drawing Sheets

FLEXTENSIONAL SONAR TRANSDUCER ASSEMBLY

BACKGROUND OF THE INVENTION

1. Field of the Invention.

The invention relates to a tensioning arrangement for a flextensional sonar transducer assembly. More specifically, the invention relates to a structure and method for tightening a band-type compression member around an elongate acoustical stack of piezoelectric crystals.

2. Description of the Related Art.

Piezoelectric elements, primarily crystals and ceramics, are employed in a variety of devices including crystal microphones, ultrasonic devices, accelerometers and oscillators. One of the most common uses of piezoelectric elements is in underwater sonar equipment in which a piezoelectric sonar transducer is stimulated by electrical signals to emit sonar signals which radiate out from the transducer. The sonar signals are reflected off of underwater objects and the reflected signals are then detected by the transducer, which in turn produces and delivers electrical signals carrying information about the underwater object.

Flextensional sonar transducers of the prior art employ a stack of piezoelectric transducer elements interspersed with electrically conducting plates for stressing the elements and for picking up electrical current produced by the elements; a prestressed compression band, made for example of a filamentwound material, wrapped about the piezoelectric stack; and an outer elliptically-shaped shell wrapped about the compression band. The stack of piezoelectric elements generally extends along the major axis of the ellipse defined by the outer shell. When an alternating voltage is applied to the conducting plates, the stack of piezoelectric elements is caused to be displaced in the direction of the major axis in proportion to the instantaneous value of the voltage. The vibration and displacement of the stack is transmitted to the shell which amplifies the vibration along the minor axis of the ellipse to produce the sonar signals. That is, as the stack expands to expand the major axis of the ellipse, the long walls of the ellipse perpendicular to its minor axis contract, and as the stack contracts to expand the long walls of the ellipse, vibration of the shell necessary to generate the sonar is produced. In an alternative arrangement of a flextensional transducer, a magnetostrictive element may replace the piezoelectric stack.

The elliptical shells used in flextensional transducers are typically preformed of filament-wound composites such as glass, reinforced plastic or aluminum. In order to incorporate the stack of piezoelectric elements in the shell, the shell is compressed along its minor axis by means of a press, and the piezoelectric stack is inserted into the shell to coincide with the major axis. Upon removal of the compressive force from along the minor axis, a residual force remains in the shell to retain the stack and apply a predetermined compressive stress thereto. Construction of the assembly in this fashion requires the piezoelectric stack and elliptical shell be prepared to close tolerances both to allow for easy insertion of the stack within the compressed shell, and to retain tight contact between the stack and the shell upon removal of the compressive forces.

The compression band allows for the application of a substantial prestress (compression) to the piezoelectric stack. The application of a compression stress to the stack by a wound compression band allows for the operation of the transducer in deep water. However, it is difficult to "wind in" as much prestress as desired due simply to the complication of winding the compression band while also maintaining the stack under stress.

When the transducer assembly is deployed in water, the increasing hydrostatic pressure with depth reduces the prestress on the stack, since the elliptical shell tends to be compressed along the minor axis thus removing shell pressure along the shell's major axis, and therefore along the major axis of the piezoelectric stack. Since tensional stress along the stack will cause it to crack and therefore be destroyed, a depth is eventually reached beyond which the transducer cannot drive without damage (the point where the forces on the stack in the major axis of the ellipse pass from compression to tension).

If however, the operational depth of the prior art transducers is exceeded, the hydrostatic pressure reduces the minor axis of the elliptical shell, and extends the major axis thereof, in a manner to exceed the prestress of the shell so that it "creeps" or moves (elongates) relative to, and then breaks away and becomes detached and decoupled from, the ends of the compression band and piezoelectric stack. When a prior art device using epoxy or the like to hold the shell in contact with the ends of the stack is subject to the deep water forces which tend to pull the shell away from the stack end pieces, sufficient tensional forces are produced thereon before the shell breaks away, to crack and destroy the crystals that make up the stack.

When "creep" and/or separation of the shell and stack occurs because of shell elongation, the shell does not return to its original position of coupling upon its removal from the high pressure, deep water environment. This is because the high hydrostatic pressure causes plastic creep, i.e., a permanent elongation-type deformation within the shell, and on return to ambient pressure, the shell remains somewhat elongated, and the drive stack can no longer efficiently couple acoustic energy therewith. The characteristics of the transducer assembly in this state are so changed that it is no longer usable at the same water depth. At deeper depths, the shell might be compressed enough along the minor axis to "squeeze" onto, and couple with, the stack to become operable. But each such use at the deeper depths causes further creep and decoupling of the shell apices from the stack, until eventually the assembly becomes inoperable at any depth (at least any depth of interest).

SUMMARY OF THE INVENTION

It is an object of the invention to provide a flextensional sonar transducer which operates accurately and may be used repeatedly at both shallow and deep water depths.

It is also an object of the invention to provide such a transducer in which the effect of creep (movement and/or plastic elongation) of the shell relative to the piezoelectric stack, is minimized or elimimated.

It is also an object of the invention to provide such a transducer in which the compression supplied to the piezoelectric stack by the compression band can be accurately adjusted.

It is further an object of the invention to provide such a transducer in which the shell and the compression band can be made to remain in driving contact with the end of the piezoelectric stack even when the assembly is in operation in deep water.

It is further an object of the invention to insulate the stack of piezoelectric elements from shell induced tensional stress thereby allowing increased operational depth without incidental tension loading of the stack.

The above and other objects of the invention are realized in a specific illustrative embodiment of a flextensional sonar transducer assembly which includes a stack of piezoelectric elements disposed along a generally linear axis, a plurality of electrodes disposed between the elements, conductors coupled to the electrodes, end pieces placed at each end of the stack with the end pieces having outwardly facing, generally arcuate surfaces, a compression band surrounding the stack and in contact with the end pieces, pressure adjustment rods positioned in partially cylindrical openings in at least one of the end pieces so as to be strategically located at the points where the compression band tends to pinch the end piece surfaces when the minor axis of the band is compressed by deep water pressure, which rods can be rotated or translated to regulate the initial pressure between the end pieces and the compression band, and a flexural shell disposed to circumscribe and contact the outer surface of the compression band. The flexural shell presents a generally elliptical side cross-section, with the major axis of the shell being generally coincident with the linear axis of the piezoelectric elements and is not rigidly attached to the end pieces of the stack. Instead, the rigid coupling between the stack and the shell, through the compression band, is replaced with a slipping friction coupling maintained by the rod members, strategically placed at points of continuous contact (pinch points) along the arcuately-shaped surfaces of the end pieces.

The method of coupling of the present invention compensates for plastic creep and allows for desirable minimum prestressing of the shell.

In accordance with one aspect of the invention, the transducer assembly is constructed by placing the adjustment rods into the partially cylindrical openings in the arcuate surfaces of the end pieces of the stack, such that a portion of the rod protrudes above the arcuate surface of the end piece at the "pinch points" thereof, i.e., at the points along the end pieces arcuate surface where the shell pinches, or remains in contact with the end pieces, even when the shell becomes detached from the stack at the central apices thereof. Once in place, the adjustment rods are then shaved or ground to be uniform with the arcuate surface of the end piece. After the compression band is wound on the end pieces, the rods are removed, partially rotated, and replaced in the openings so as to create further compression in the piezoelectric stack. (Alternatively, the rods may be rotated without being removed.) Since this method of construction results in the compression band supplying substantially all of the desired prestress, there is advantageously no particular need for the shell itself to provide any appreciable amount of the compressive prestress in the stack.

The use of the rod members to tighten the compression band enables higher pressures to be applied to the stack by the compression band than can be achieved by using the compression band alone. The rod adjustment method also enables precise reproduction of the prestress levels from one transducer to another, thereby allowing accurate prediction of the optimal operational depth of each transducer.

The present invention has considerable performance advantages over the prior art.

First, since the outer shell remains in a relatively unstressed state until it is deployed and operational at the depths approaching its maximum predetermined operation pressure, it is not subject to deterioration of its prestress condition due to static creep therein over time.

Second, since the shell is not bonded to the stack end pieces, nor to the compression band, its creeping motion during high water pressure operation can never result in a tensile stress being applied to the stack.

Third, since driving contact is maintained between the stack, compression band and shell at all times during operation of the device (even if creep occurs), acoustical energy is always efficiently coupled between the shell and the stack; and Fourth, the rods allow for very accurate adjustment of the prestress compression load at pressures much higher than are attainable in prior art devices employing the compression band alone.

BRIEF DESCRIPTION OF THE DRAWINGS

The above and other objects, features and advantages of the invention will become apparent from a consideration of the following detailed description presented in conjunction with the accompanying drawings in which.

DETAILED DESCRIPTION OF THE INVENTION

Figure 1:
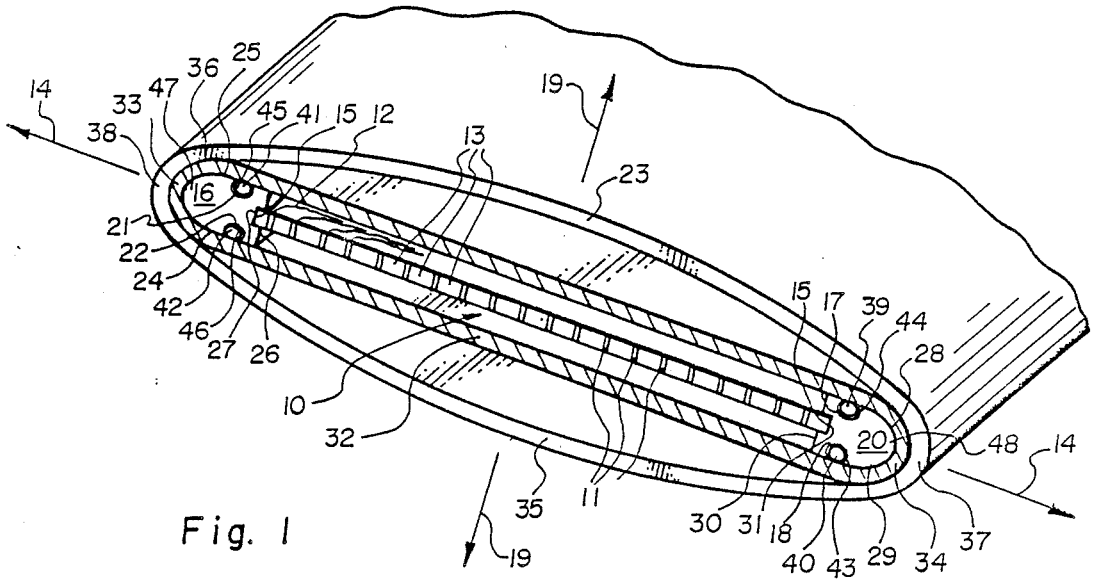
FIG. 1 shows a fragmented, perspective view of a flextensional sonar transducer assembly made in accordance with the principles of the invention.

Referring to FIG. 1, there is shown a perspective, partially fragmented view of an elliptical shell flextensional sonar transducer assembly constructed for greater and repeatable depth capability than possible with currently used devices. The assembly includes a stack 10 of piezoelectric elements or crystals 13 laid out in a linear array, with plate electrodes 11 disposed between the elements 13. Conductors 12 carry electrical signals to the electrodes 11 to stress the piezoelectric elements 13 and cause them to vibrate longitudinally along the major axis 14 of the stack 10. The conductors 12 also carry electrical signals produced by the stack 10 of piezoelectric elements 13 when the elements intercept sonar signals, all in a well-known manner.

End pieces 16 and 20 are located at respective ends of the stack 10 and intimately coupled therewith. The end pieces 16 and 20 are formed with their longitudinal axis being in a direction at right angles from major axis 14 and minor axis 19 and with outwardly facing, generally arcuate surfaces 24, 25, 28 and 29. These arcuate surfaces have been formed into their specific geometric shape for purposes which will be explained later. The arcuate surfaces 24, 25, 28 and 29 accommodate the filament-wound compression band 32 which is looped about the end pieces 16 and 20 and stack 10.

The end pieces 16 and 20 also include opposed faces 26 and 30 in which are formed notches 27 and 31 respectively for fitting over respective ends of the stack 10. The stack 10 and end pieces 16 and 20 are initially joined together by an adhesive 15 such as epoxy resin, and further held together and prestressed by the compression band 32. The end pieces 16 and 20 might illustratively be made of aluminum, steel or hard plastic. The compression band 32 might illustratively comprise a relatively stiff filament-wound layer of material such as Kevlar (TM), E-Glass, or S-Glass, which would be formed and wound directly about the stack 10 and end pieces 16 and 20. The particular manner in which the compression band is to be wound around the stack 10 will be more fully described later. The compression band material would then be cured, (if curing were required) in a conventional fashion.

Circumscribing the compression band 32 is a flexural shell 36, preformed, for example, from filament-wound composites such as glass-reinforced plastic, or metal such as aluminum. The shell 36 is formed to have a generally elliptical side cross-section, as shown in FIG. 1, with the major axis of the ellipse coinciding generally with the major axis 14 of the piezoelectric stack 10, and with the minor axis 19 of the ellipse being generally perpendicular to the axis of the stack 10 and to long walls 23 and 35 of the shell 36.

Figure 2:
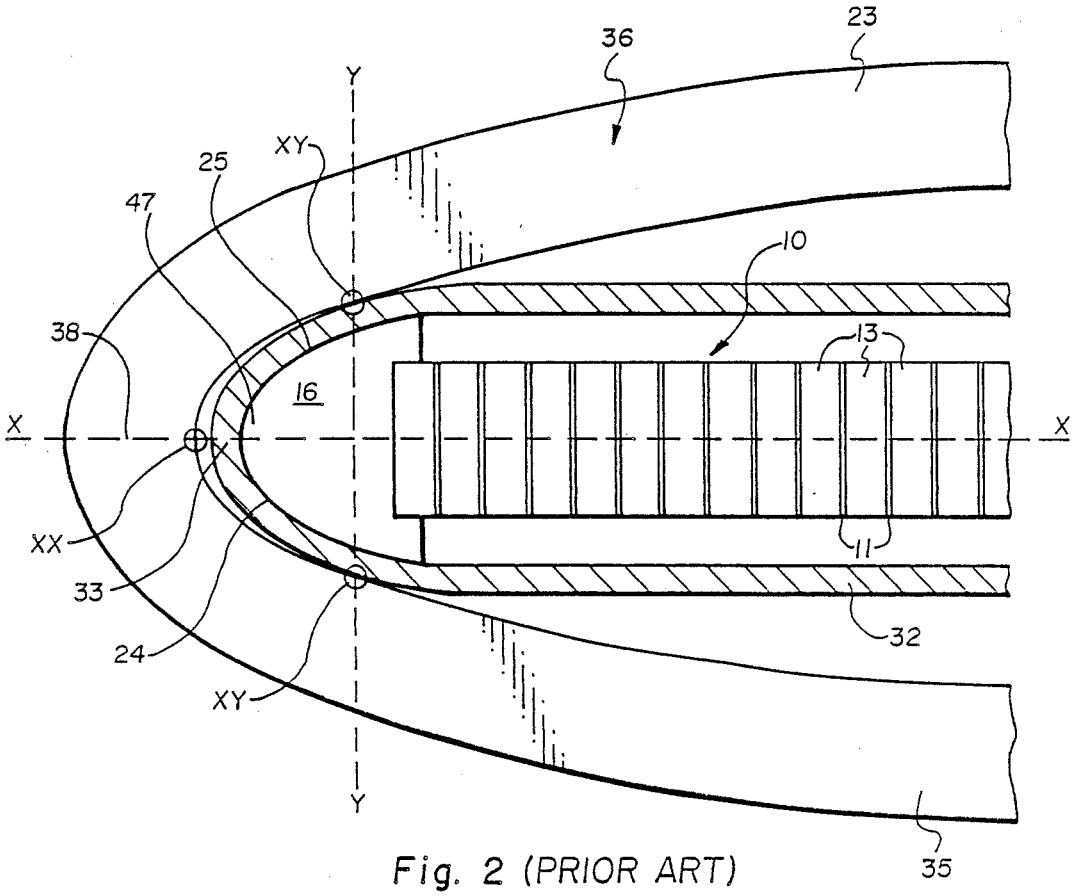
Fig. 2 (PRIOR ART)
FIG. 2 shows the transducer of FIG. 3 in a loaded state, and shows the shell movement caused by deep water pressure.
Figure 3A:
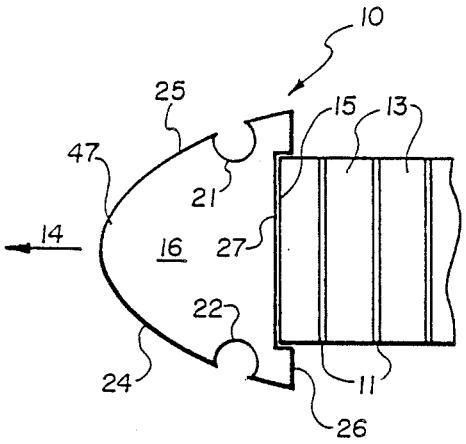
FIGS. 3 (*a*)–(*e*) show side cross-sectional views of one end of the invention with the shell member removed, and represent the step-by-step process of prestress compression loading using the adjustment rods.
Figure 3B:
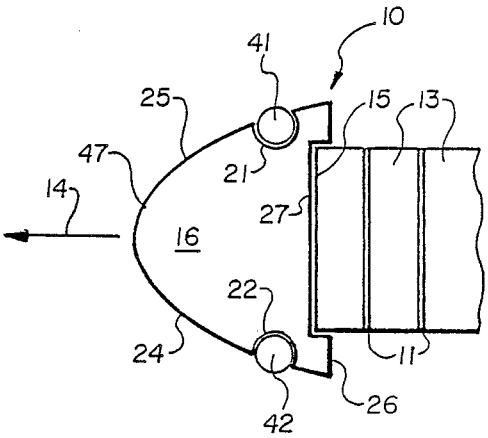
Figure 3C:
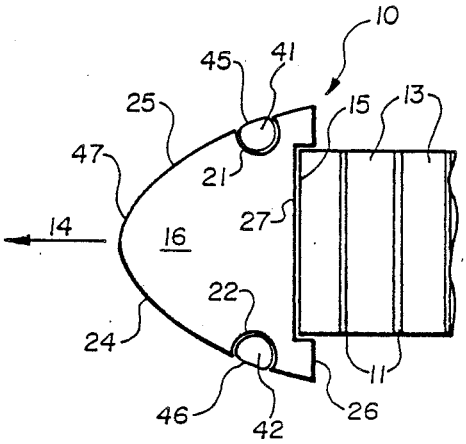
Figure 3D:
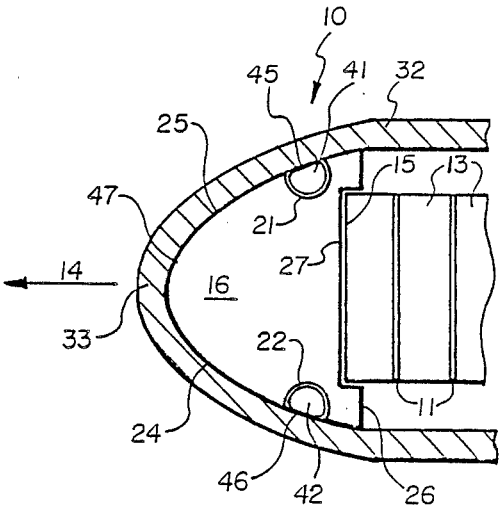
Figure 3E:
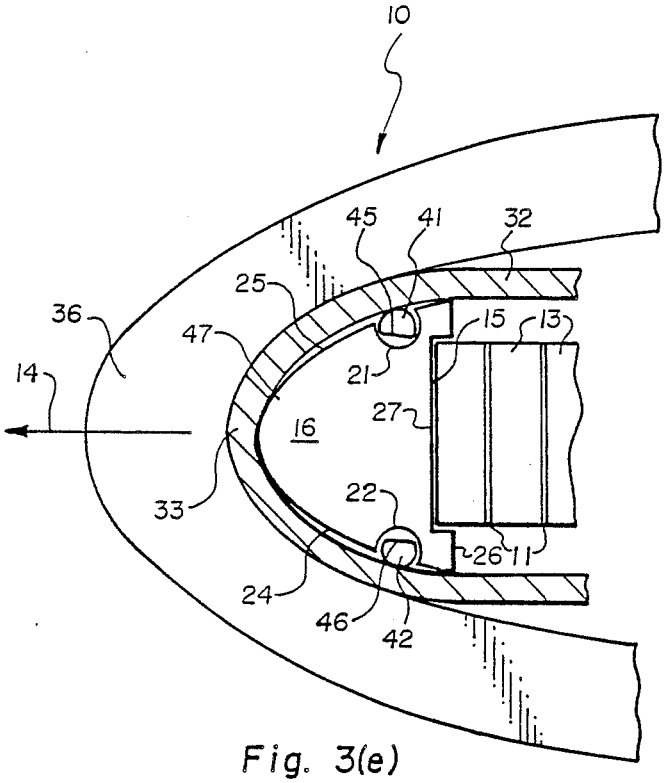

In the prior art, the shell 36 typically is bonded at its apices 37 and 38 to the apices 33 and 34 of the compression band 32. As shown in FIG. 2, the prior art relies on points XX for energy transfer between the shell 36 and the stack 10. Then when the transducer is used at great depths, compression of the minor axis 19 of the shell 36 due to water pressure, causes the shell apices 37 and 38 to detach from the band's apices 33 and 34. When this occurs, point XX is no longer in contact with the compression band 32 or the stack 10, as is best shown in FIG. 2. This, of course, impedes or eliminates the transfer of energy between the shell and piezoelectric stack 10 rendering the transducer unusable, at least at shallow depths as discussed earlier. With continued deployment at greater depths, the transducer eventually becomes unusable because of continued creep of the shell 36 and the ultimate lack of driving contact between the shell 36 and stack 10 at any depth.

In the present invention, this problem is overcome by the end pieces arcuate surfaces 24, 25, 28 and 29 and the adjusting rods 39, 40, 41 and 42. Referring again to FIG. 2, the geometry of the arcuate surfaces 24, 25, 28 and 29 are such that when the shell becomes detached at the apices 37 and 38 thereof, it is required to remain close to the end pieces 16 and 20, through the compression band 32, at points XY. These points XY, best referred to as "pinch points" are located at symmetric positions on either side of the center apex 47, 48 of each arcuate end piece surface 24, 25, 28 and 29. Thus, when the shell 36 is subjected to deep water pressure, it extends over and moves away from the compression band apices 33 and 34, yet remains close to the compression band 32 at the pinch points XY.

Because of this geometrical feature of the present invention, the effects of creep or longitudinal movement of the shell 36 relative to the compression band 32 can be compensated for and essentially nullified. This is accomplished by incorporating pressure adjustment rod members 39, 40, 41 and 42 into the arcuate end pieces 16 and 20, beneath the compression band 32, at the location of the pinch points XY. Each rod member 39, 40, 41 and 42 is formed with a cross-section which is generally circular except for a small generally flat section 43, 44, 45 and 46 of its circumference which is shaped during assembly to match the surface of the arcuate end piece 24, 25, 28 or 29 in which it is placed. The rod members 39, 40, 41 and 42 are located in correspondingly shaped partially cylindrical openings 17, 18, 21 and 22 in the end piece arcuate surfaces 24, 25, 28 and 29, in an orientation which causes a portion thereof to protrude above the arcuate surface 24, 25, 28 or 29 and push upon the compression band 32, (thus indirectly pushing upon the shell 36). When the rods 39, 40, 41 and 42 are so placed, the shell 36 cannot lose its contact with the compression band 32, regardless of the external pressure applied thereto. This is because the same external pressure which causes movement of the shell apices 37 and 38 away from the compression band apices 33 and 34, also causes the portion of the shell 36 located adjacent the rod members 39, 40, 41 and 42 to tighten or "pinch" against the compression band 32. The rods 39, 40, 41 and 42 therefore essentially eliminate the effects of creep by insuring a driving contact between the shell 36 and the stack 10, and the stack 10 remains capable of efficiently coupling acoustic energy to the shell 36, and vice versa, at all water pressures.

At atmospheric pressure, the residual pressure in the shell 36, generated when the shell was wound onto the stack of elements 10 thereinto, holds the shell 36 against the compression band apices 33 and 34 at the pinch points XY. Also, at atmospheric pressure, the compression generated when the compression band 32 was wound onto the stack 10, along with the additional pressure generated during placement of the adjustment rods 39, 40, 41 and 42, hold the compression band 32 against the end pieces 16 and 20. At deep water pressures, as shown in FIG. 2, the water pushing against the long walls 23 and 35 of the shell 36 tends to increase its length along the major axis 15, and move the shell apices 37 and 38 away from the compression band apices 33 and 34. The long walls 23 and 35, however, are pushed against the the pinch points XY.

The adjustable compression rods 39, 40, 41 and 42 not only aid in maintaining driving contact between the shell 36 and the stack 10 by means of their location at the pinch points XY, they also function to accurately adjust the prestress compression load on the stack 10. As will be explained later, because of the slightly irregular cross-section of the rods 39, 40, 41 and 42 due to the portions 43, 44, 45 and 46 which are ground flat during assembly of the device, their rotational orientation with respect to the end piece surfaces 24 and 28 causes a pre-determined distance of protrusion of a portion of each rod 39, 40, 41 and 42 therefrom. As is readily obvious, any protrusion beyond the surfaces 24, 25, 28 and 29 will tend to increase the compression forces that the compression band applies to the stack. This protrusion distance can be calculated in order to apply a precise predetermined amount of compression pressure to the stack 10.

The transducer assembly described above may advantageously be constructed, by first assembling a stack 10 of piezoelectric elements 13 generally along a linear axis and between opposed end pieces 16 and 20 which have arcuate surfaces 24, 25, 28 and 29 with partially cylindrical openings 17, 18, 21 and 22 formed therein, and the appropriate electrodes 11 disposed between the elements. The stack 10 is secured together by a suitable adhesive 15 such as epoxy resin. Next, as shown in FIGS. 3(*a*)–(*b*), the adjustable rods 39, 40, 41 and 42 are placed in the partially cylindrical openings 17, 18, 21 and 22 in the end pieces 16 and 20 and the protruding portions thereof are shaved or ground off to create flat portions 43, 44, 45 and 46 (FIG. 3(*c*)) which match the arcuate contour of the end piece surfaces 24, 25, 28 and 29. With the rods in place, the compression band 32 is then wound around the stack 10 and end pieces 16 and 20 (FIG. 3(*d*)) in such a manner as to create a compression load on the stack 10 as a result of the winding. The compression band windings are allowed to cure if necessary, and then the outer shell 36 is wound over the compression band windings as shown in FIG. 3(*e*), the rods 39, 40, 41 and 42 are then removed from the openings 17, 18, 21 and 22 and rotated a predetermined distance to cause a protrusion of a portion thereof a precalculated distance above the arcuate surfaces 24, 25, 28 and 29 of the end pieces 16 and 20 when replaced. Then, the rods 39, 40, 41 and 42, in their rotated orientation, are replaced into the partially cylindrical openings 17, 18, 21 and 22 to generate the pre-determined compression load in the stack 10. The distal ends of the adjustment rods (not shown) may be tapered in any well-known manner in order to facilitate their replacement. When generated with the rotatable adjustment rods 39, 40, 41 and 42, the compression load can far exceed the compression loads possible when the compression band 32 was used alone.

Figure 4:
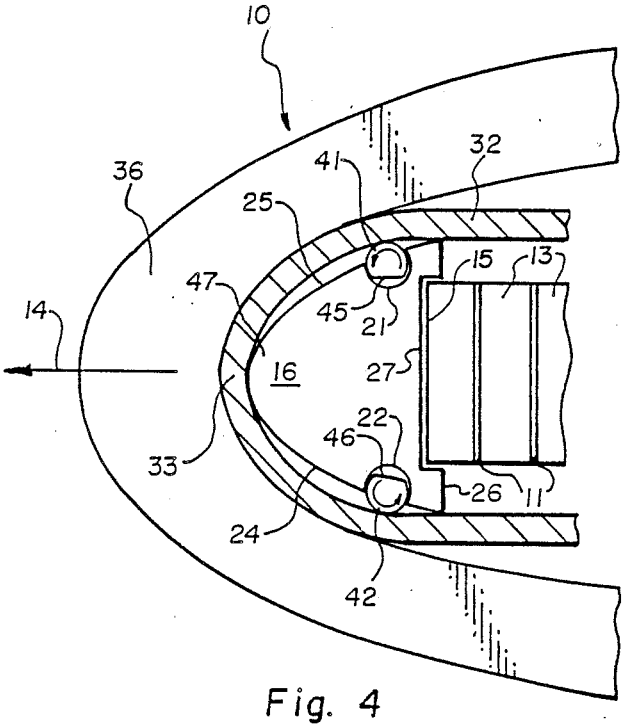
FIG. 4 shows a side cross-sectional view of one end of the invention with the shell member removed, and represents a modification of the step-by-step process of prestress compression loading shown in FIGS. 3 (*a*)–(*e*).

An alternative method of assembly of the transducer is shown in FIG. 4 and advantageously includes the step of rotating the adjustment rods 39, 40, 41 and 42 in place in the partially cylindrical openings 17, 18, 21 and 22, in lieu of the steps of removal, rotation and replacement as shown in FIG. 3(*e*). In either event, the distance of protrusion is calculated to generate the desired prestress compression of the stack 10.

Although the above description of illustrative embodiments was made with respect to a stack of piezoelectric elements, it should be understood that magnetostrictive devices could also be used in place of the piezoelectric stack.

It is to be understood that the above-described arrangements are only illustrative of the application of the principles of the invention. Numerous modifications and alternative arrangements may be devised by those skilled in the art without departing from the spirit and scope of the present invention, and the appended claims are intended to cover such modifications and arrangements.

What is claimed is:

1. A flextensional sonar transducer assembly including a stack of piezoelectric elements disposed along a linear axis, a plurality of electrodes disposed between said elements, means for conducting electrical signals to and from said electrodes, end pieces disposed at each end of said stack, said end pieces having outwardly facing arcuate surfaces and center apices, a compression band formed into a loop to extend along one side of said stack, arcuately about one of said end pieces and back along the other side of said stack, and arcuately about the other of said end pieces to said one side, a flexural shell disposed to circumscribe said compression band to present an elliptical side cross-section, with the major axis thereof being coincident with said linear axis, and said shell being reactively coupled to the arcuate end portions of said compression band so that an inwardly directed transverse movement of the long sides of said shell toward said stack, allows for longitudinal expansion of said stack, and an outwardly directed transverse movement of the long sides of said shell away from said stack, causes longitudinal compression of said stack, and means positioned between said compression band and at least one of said end pieces for urging the compression band away from the end piece to thereby produce a tensile stress in the band and a compressive stress in the stack whereby, said urging means maintains driving contact between said stack and said shell through said compression band.

2. An assembly as in claim 1 wherein said urging means includes at least one elongate opening formed at the arcuate surface of at least one of said end pieces, said at least one end piece having a longitudinal axis which extends in a direction normal to said elliptical side crosssection, said at least one elongate opening extending parallel with said longitudinal axis of said end piece, and at least one elongate insert for placement in the opening so that a portion of the insert protrudes above the arcuate surface of the end piece to urge the compression band away from the end piece and thus increase the compressive stress in the stack.

3. An assembly as in claim 2 wherein said urging means includes two elongate openings formed in each end piece to extend parallel with said longitudinal axis and spaced apart on either side of the center apex of said each end piece, and four elongate inserts, each for placement in a different one of said openings.

4. An assembly as in claim 3 wherein said openings and said inserts are semicylindrical in shape.

5. An assembly as in claim 4 wherein said inserts are tapered at one end.

6. A method of constructing a flextensional sonar transducer comprising the steps of:

assembling a stack of piezoelectric elements along a linear axis and between opposed end pieces having outwardly facing arcuate surfaces with electrodes being disposed between the elements, placing urging means adjacent at least one arcuate surface of at least one end piece, winding a compression band about the stack, urging means and opposed end pieces, with the band extending arcuately about the end pieces, forming a flexural shell having an elliptical side cross-section around the compression band, and rotating said urging means, whereby said urging means functions to increase the tensile stress in the compression band and the compressive stress in the stack and to maintain driving contact between the stack and the shell.

7. A method of constructing a flextensional sonar transducer according to claim 6 wherein said at least one end piece comprises a longitudinal axis which extends in a direction normal to said elliptical side cross-section, the method further including the steps of:

forming an elongated opening in at least one arcuate surface of at least one of said end pieces said opening extending parallel with the longitudinal axis of the end piece, and placing said urging means in said at least one elongated opening.

8. A method of constructing a flextensional sonar transducer according to claim 7 wherein said urging means comprises at least one rod member and further comprising the step of:

disposing said at least one rod member in the at least one elongate opening and grinding off a portion of the at least one rod member which protrudes above the arcuate surface before winding the compression band about the stack and end pieces, and rotating the at least one rod member after the compression band and shell are wound about the stack and end pieces.

9. A method of constructing a flextensional sonar transducer according to claim 8 wherein the step of rotating the at least one rod member includes first removing the at least one rod member from the end pieces before rotation and then replacing the at least one rod member in the end pieces after rotation.

10. A method of constructing a flextensional sonar transducer according to claim 9 wherein the step of grinding includes grinding the at least one rod member until the protruding portion thereof is removed and the ground portion conforms to the contour of the at least one arcuate end piece surface.

* * * * *